US006729219B2

(12) United States Patent
Long

(10) Patent No.: US 6,729,219 B2
(45) Date of Patent: May 4, 2004

(54) KNIFE ATTACHMENT FOR A SHEET CUTTING SYSTEM

(75) Inventor: Donald Blaine Long, Kenesaw, GA (US)

(73) Assignee: Long Industries, Inc., Dallas, GA (US)

( * ) Notice: Subject to any disclaimer, the term of this patent is extended or adjusted under 35 U.S.C. 154(b) by 0 days.

(21) Appl. No.: 10/396,993

(22) Filed: Mar. 25, 2003

(65) Prior Publication Data

US 2003/0177881 A1 Sep. 25, 2003

Related U.S. Application Data

(60) Provisional application No. 60/367,170, filed on Mar. 25, 2002.

(51) Int. Cl.[7] ..... B26D 1/04

(52) U.S. Cl. ..... 83/614; 83/640; 83/698.11

(58) Field of Search ..... 83/614, 635, 823, 83/623, 698.31, 698.41, 455, 640, 698.11, 699.31, 699.41, 699.61, 574, 581, 56, 544, 546, 563, 881, 821, 32.2, 425, 471.3, 485, 471.2, 473, 432, 437

(56) References Cited

U.S. PATENT DOCUMENTS

| | | | | | |
|---|---|---|---|---|---|
| 2,835,037 | A | * | 5/1958 | Middents | 33/485 |
| 3,964,360 | A | * | 6/1976 | Schwartz | 83/464 |
| 3,973,459 | A | * | 8/1976 | Stowe | 83/455 |
| 3,996,827 | A | * | 12/1976 | Logan | 83/455 |
| 4,058,150 | A | * | 11/1977 | Pennington | 144/1.1 |
| 4,231,275 | A | * | 11/1980 | Onishi | 83/862 |
| 4,802,399 | A | * | 2/1989 | Olson | 83/425 |
| 4,864,729 | A | * | 9/1989 | Funger | 30/290 |
| 4,987,682 | A | * | 1/1991 | Minnick | 30/295 |
| 5,075,974 | A | * | 12/1991 | McIlhatten | 30/290 |
| 5,269,212 | A | * | 12/1993 | Peters et al. | 83/455 |
| 5,974,671 | A | * | 11/1999 | Dunn | 30/283 |
| 6,283,003 | B1 | | 9/2001 | Hanson et al. | 83/614 |
| 6,367,154 | B2 | * | 4/2002 | Degabli | 30/123 |

OTHER PUBLICATIONS

Http://www.sawtrac.com/Page27.html, a panel saw having a utility knife, dated Aug. 25, 2002, two pages.* www.sawtrax.com . using an old style knife dated Feb. 16, 2002.

Saw Trax advertising brochure 2003 showing old style knife.

Saw Trax brochure showing old style knife, date unknown.

Page from the magazine sign business dated Mar. 2003 showing knife.

* cited by examiner

*Primary Examiner*—Allan N. Shoap
*Assistant Examiner*—Ghassem Alie
(74) *Attorney, Agent, or Firm*—Thomas, Kayden, Horstemeyer & Risley, LLP

(57) ABSTRACT

A knife attachment for a sheet cutting system which has a base with a hole with a mounting plate adjacent the hole and having extension with a slot that extends towards the base at an acute angle. The extension has a ledge above the slot. A utility knife is held in a knife holding bracket that is attached to the extension by a bolt and nut that extends through the slot in the extension. The knife has a slot between a tab attached to the body of the knife near the blade that fits over the front edge of the securing plate to hold the knife in position. A holding plate is attached to the securing plate to prevent the knife from moving horizontally.

7 Claims, 3 Drawing Sheets

KNIFE ATTACHMENT FOR A SHEET CUTTING SYSTEM

CROSS REFERENCE TO RELATED APPLICATIONS

This application claims priority from U.S. Provisional Application Serial Number 60/367,170 filed Mar. 25, 2002, with the same title, listing Donald Blaine Long as the inventor.

FIELD OF THE INVENTION

This invention relates to a sheet cutting system and, in particular, to a knife attachment that is interchangeable with a panel saw for attachment to a sheet cutting system.

BACKGROUND OF THE INVENTION

Systems for cutting sheet material, such as, sheet rock and wood panel have been known for many years.

The prior art mat cutting systems generally use a knife or blade. U.S. Pat. No. 6,283,003 to Hans on et al uses a blade that is held by a blade holder in a cutting head.

U.S. Pat. No. 4,802,399 to Orlon discloses a support for holding a construction size sheet for cutting by a saw attachment on a carriage. The carriage travels on a pair of rails and guide tubes to saw a cut in the work piece.

Saw Tax Mfg. of Actor, Ga., has a construction type cutting system, which uses an ordinary utility knife fastened to a sheet metal bracket. Unfortunately, the attachment is not rigid and does not achieve the desired accuracy in use.

SUMMARY OF THE INVENTION

An object of the present invention is to provide a rigid utility knife attachment for commercial graphic arts and construction cutting systems. A further object of the present invention is to provide a utility knife attachment that is easy to assemble, easy to change blades and easy to adjust for depth penetration.

These and other objects of the present invention are fulfilled by a knife attachment that has a base with a front surface and a back surface. The back surface faces a sheet of material held in position adjacent the base that is to be cut or scored. The base has a hole extending between the front and back surfaces. A mounting plate is mounted on the front surface of the base adjacent to the hole. This mounting plate has an extension that is perpendicular to the base and which has a slot that extends from the portion of the extension away from the base towards the base at an acute angle to the base.

A knife holding bracket is attached to the extension of the mounting plate by attaching means, such as a bolt and wing nut, so that the knife holding bracket can be moved along the slot in the extension. A stud may be extended through the slot in the extension of the mounting plate and into the threaded hole in the knife holding bracket to hold it in proper position in relation to the slot. The knife holding bracket has a securing plate, which is parallel to the base and located on that portion of the bracket closest to the hole in the base. This securing plate is attached to a holding plate that is perpendicular to the base and spaced close enough to the knife holding bracket to prevent the knife from moving laterally. A utility knife having an extendible blade is attached to the knife holding bracket by means such as the same bolt and wing nut that attaches the knife holding bracket to the extension of the mounting plate. The knife is disposed between the knife holding bracket and the holding plate of the knife holding bracket. The blade of the knife can be inserted into the hole to the desired depth. The knife has a tab near the blade end of the knife that is spaced from the body of the knife and projects away from the blade end of the knife and can be inserted under the front edge of the securing plate to hold the knife securely. The knife holding bracket and attached knife can be slid along the slot of the extension of the mounting plate so as to determine the depth of penetration of the blade of the knife into the sheet material being cut. This knife is a conventional utility knife, which has a tab on the handle at the blade end which can be used for securing the knife to the knife holding bracket.

It will be seen that the securing plate of the knife holding bracket prevents the knife from moving in a perpendicular fashion in respect to the base unless the knife holding bracket is moved along the slot in the extension of the mounting plate. Preferable a bolt with a wing nut is used to hold the knife to the knife holding bracket and extension of the mounting plate, but can be adjusted to permit the bracket and knife to be moved along the slot to the depth of the knife blade into the material being cut that the operator desires. The wing nut can then be tightened to hold the knife blade in that position. A holding plate located along the edge of the securing plate away from the knife holding bracket at a distance slightly greater than the width of the knife secures the knife from moving side to side. Securing the knife in this manner enables the user to accurately cut the piece of material.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF PREFERRED EMBODIMENTS

Figure 2:
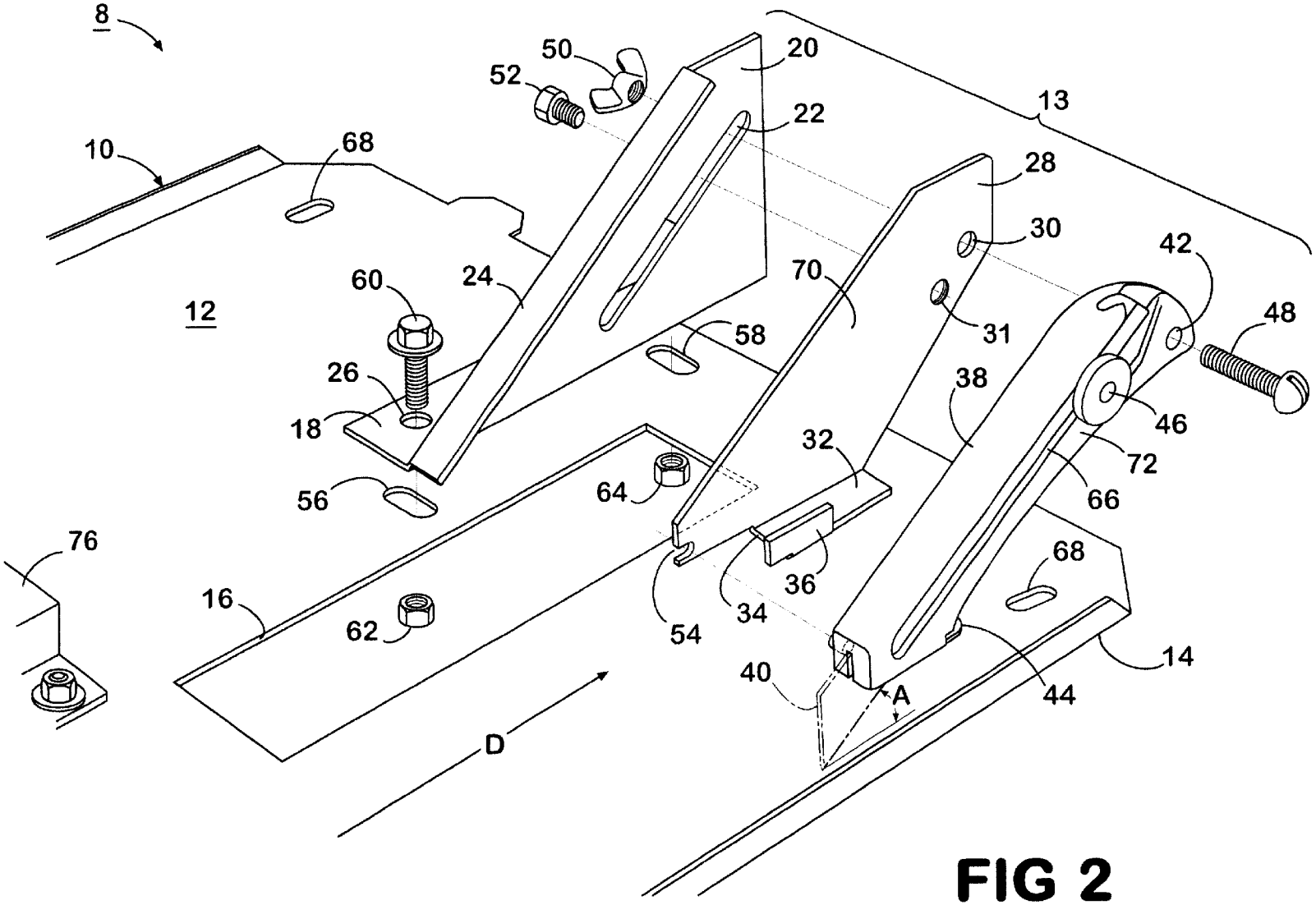
FIG. 2 is a perspective exploded view of the knife attachment of the present invention which has not been assembled together.
Figure 3:
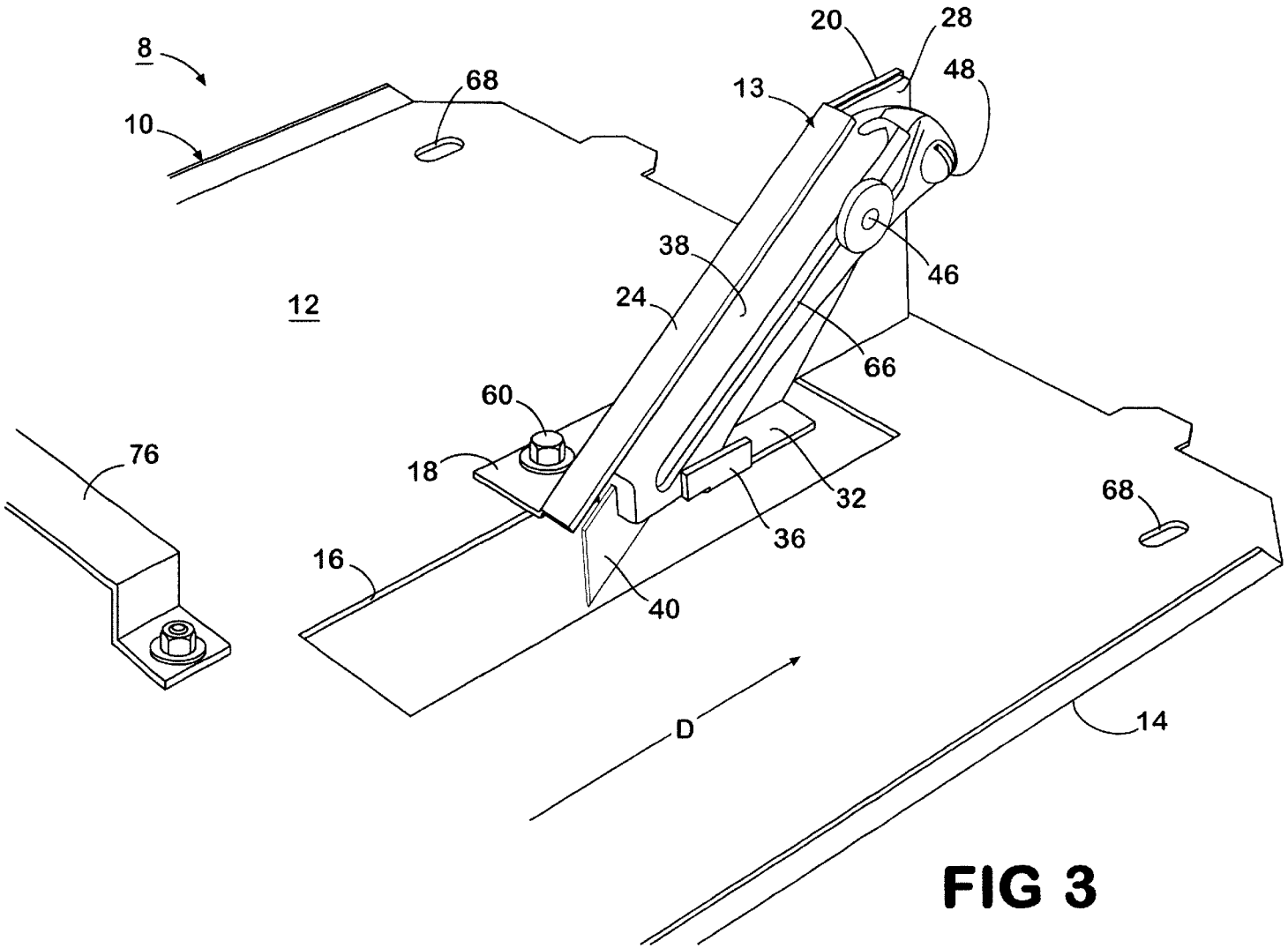
FIG. 3 is a perspective view of the knife attachment of the present invention which has been assembled.

The knife attachment 8 of this invention has a base 10 with a top surface 12 and bottom surface 14. A hole 16 is located so the knife holding device 13 can be attached adjacent to the hole 16. The knife holding device 13 has a mounting plate 18 as illustrated in FIGS. 2 and 3. The mounting plate 18 has extension 20 that is perpendicular to the mounting plate 18 and to the base 10 when the mounting plate 18 is mounted on the base 10. The extension 20 has a slot 22 for the attachment of the knife holding bracket 28 and utility knife 38 and the adjustment of the knife and the depth of penetration of the blade 40 of the knife 38 into the material being worked on. The mounting plate 18 has a holding ledge 24 for holding the knife holding bracket 28 in the proper position. The mounting plate 18 has holes 26 for attachment to the base 10 by a bolt 60 and nut 62 and a bolt (not shown) and nut 64. These bolts extend through holes 56 and 58 in the base 10. The base 10 has securing means (unnumbered) that extend through apertures 68 for securing the base 10 to the plate behind the base 10.

The knife holding bracket 28 is illustrated in FIGS. 2 and 3. It has a bolt hole 30 for attaching a bolt 48 to the extension 20 of mounting plate 18 through slot 22. The knife holding bracket has a securing plate 32 that is perpendicular to the knife holding bracket 28. The securing plate 32 has a front edge 34 that will be discussed intra. The knife holding bracket 28 has a holding plate 36 that is attached to the securing plate 32 to hold the knife 38 from movement from side to side. The knife 38 has a blade 40 and the bolt hole 42 for mounting the knife 38 to the knife holding bracket 28 and the extension 20 of the mounting plate 18. The knife 38 has a tab 44 on the bottom of its handle 72 near the blade 40, which is used to secure the knife to the knife holding bracket 28. The knife has a knob 46 for extending and retracting the blade 40. The knife 38 is mounted to the knife holding bracket 28 by inserting a bolt 48 through bolt hole 42 in the knife and bolt hole 30 in the knife holding bracket 28 and through slot 22 of the extension 20 of the mounting plate 18 which may be secured by a wing nut 50 for easy attachment and removal. The knife holding bracket 28 can be moved into proper position relative to said extension 20 and secured in that position by tightening wing nut 50. A stud 52 may be inserted through slot 22 and threaded into threaded hole 31 to help stabilize holding bracket 28 during the cutting operation. The stud 52 could be a simple pin.

The tab 44 is inserted under the front edge 34 of the securing plate 32 to hold the knife 38 in proper position and to prevent vertical travel of the knife 38 in relation to holding bracket 28. There is a space between the bottom of the handle 72 of the knife 38 and tab 44 into which the front edge 34 of the securing plate 32 is inserted. Additional stability of the knife 38 can be obtained by putting a notch 54 in the front edge of knife holding bracket 28 into which a stud (not shown) on the utility knife 38 is inserted.

The knife holding bracket 28 and knife 38 are mounted on the extension 20 so the blade 40 of the knife 38 is at an acute angle A to the base 10 as that is the best angle at which to cut with a utility knife.

The mounting plate 18 to which the knife holding bracket 28 and knife 38 are attached, is attached to the base 10 so that the knife blade 40 projects through the hole 16 in the base 10 for cutting material.

Figure 1:
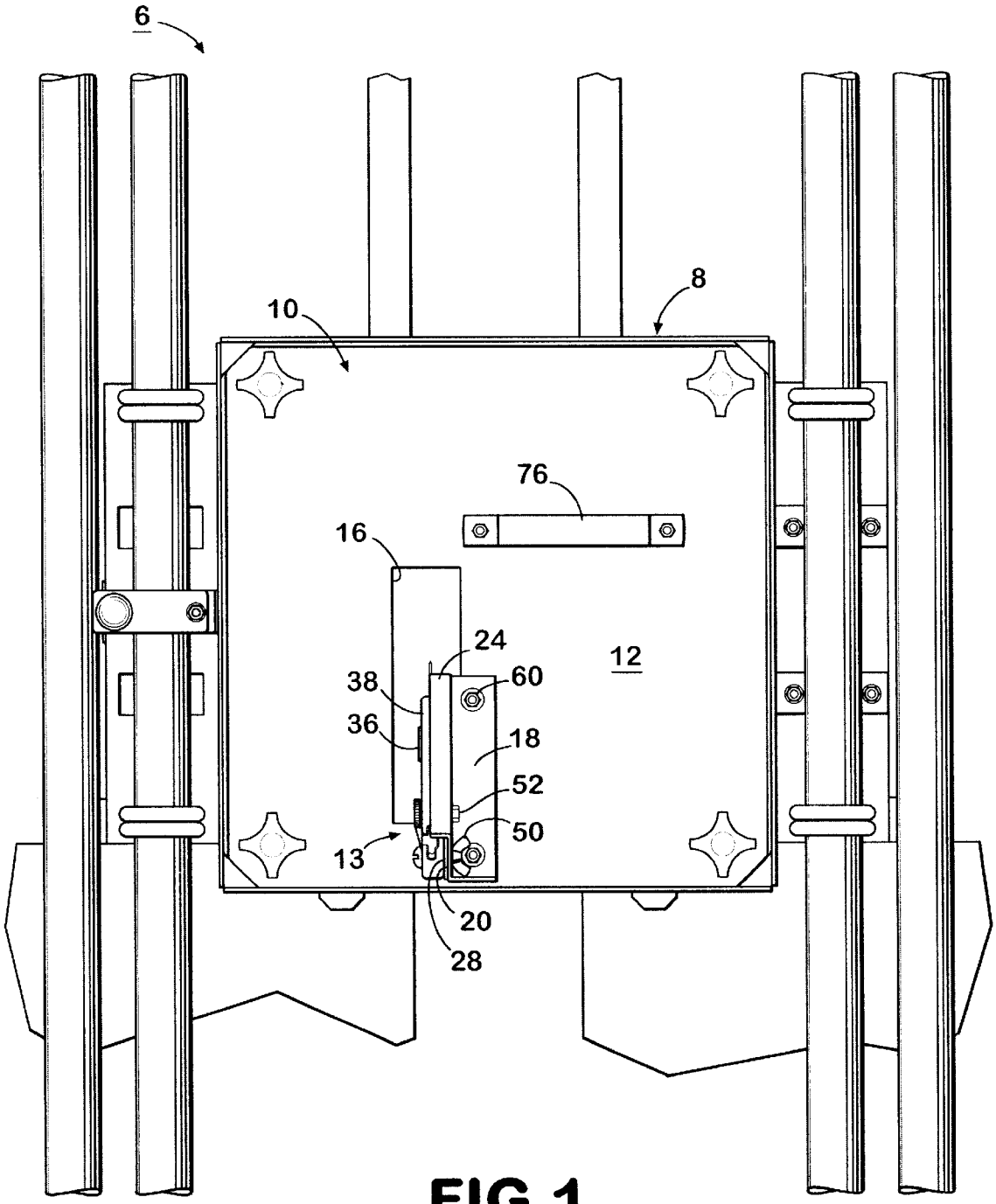
FIG. 1 is a front view of a sheet cutting system to which the knife attachment of the present invention has been installed.

The base 10 is supported on a frame 6 of a sheet cutting system and the work sheet is secured in this frame adjacent to the base 10 for cutting as shown in FIG. 1. The knife attachment of the present invention is durable but is also versatile to cut sheet material having a width range of thickness. In addition, the knife attachment can be used for scoring operations on sheet rock, wood panel, hard plastic and the like. The base 10 can be rotated 90 degrees to rip through material, if desired. The base 10 can be moved in the direction D indicated in FIG. 2 to cut material by handle 76. The knife attachment of this invention can be adjusted to perform the desired cutting or scoring of the material by adjusting the knife holding bracket 28 along slot 22 of extension 20. In addition, the blade 40 of the knife 38 can be adjusted by knob 46 in the conventional manner by moving it along knife slot 66 which moves the blade 40 as desired.

The present invention having been thus described with particular references to the preferred forms thereof, it will be obvious that various changes and modifications may be made therein without departing from the spirit and scope of the present invention as defined in the appended claims.

I claim:

1. A knife attachment for a sheet cutting system having a frame that supports a sheet, said knife attachment comprising:

(a) a base having a front surface and back surface, said base having a hole extending there through between said front and back surfaces;

(b) a mounting plate mounted on said front surface of the base adjacent said hole, said mounting plate having an extension that is substantially perpendicular to the base and which has a slot that extends towards said base at an acute angle thereto, said mounting plate having a holding ledge which is substantially parallel to the slot and disposed away from said base;

(c) a utility knife held by a knife holding bracket attached to said extension of said mounting plate by attaching means so that the knife holding bracket can be moved along said slot and secured in a position relative to said extension, said knife holding bracket having a securing plate with a front edge which is substantially parallel to the base and located closest to said hole in said base, said knife holding bracket having knife securing means to prevent movement of said knife in a plane parallel to said base; and (d) said knife having two ends with a blade that can be extended from one end, said blade being held at an acute angle to said base, said knife having means to securely attach said knife to said holding bracket, said knife is disposed between said knife holding bracket and said holding ledge of said extension of said mounting plate, with said blade of said knife located adjacent to said hole, said knife having a tab located on the knife near said blade, said tab being attached to said knife so there is a slot between said tab and said knife near the blade so that said slot can be interposed over said front edge of said securing plate to hold the knife securely, said knife and knife holding bracket being capable of sliding along the slot to define a penetration path for said blade of said knife in said hole of said base.

2. The knife attachment of claim 1 in which said attaching means for attaching the knife holding bracket to the mounting plate is a bolt that extends through the knife holding bracket and the slot in the mounting plate and is secured by a nut.

3. The knife attachment of claim 2 in which the knife holding bracket is further secured from moving away from the slot in said extension of said mounting plate by a stud that extends through said slot and into a threaded aperture in said knife mounting holding bracket.

4. The knife attachment of claim 1 in which the securing means to prevent movement of said knife in relation to said knife holding bracket is a holding plate that is attached to the securing plate on the knife holding bracket, said holding plate being at least substantially parallel to said knife holding bracket and placed a sufficient distance from the knife holding bracket to permit the knife to be interposed between said holding plate and said knife holding bracket and held securely in that position.

5. The knife attachment of claim 1 in which the attaching means for attaching the holding bracket to said mounting plate and the means to attach said knife to said knife holding bracket is a bolt that extends through an aperture in the knife and an aperture in the holding bracket and through the slot in the extension of the mounting plate and is held secure by a nut.

6. The knife attachment of claim 1 in which the knife holding bracket has a notch and the knife has a stud that is placed in the said notch to more securely hold the knife of the knife holding bracket.

7. The knife attachment of claim 1 which has a handle attached to the base for moving the knife attachment so that the knife blade will cut a sheet of material in the system.

* * * * *